US006245129B1

(12) United States Patent
Yoshikawa

(10) Patent No.: US 6,245,129 B1
(45) Date of Patent: Jun. 12, 2001

(54) APPARATUS FOR REMOVING SOLVENTS, SYSTEM FOR REMOVING SOLVENTS, METHOD FOR REMOVING SOLVENTS, AND METHOD FOR PRODUCING TONERS FOR USE IN DEVELOPING ELECTROSTATIC CHARGE IMAGES

(75) Inventor: Hideaki Yoshikawa, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/450,776

(22) Filed: Nov. 30, 1999

(30) Foreign Application Priority Data

Jan. 18, 1999 (JP) ..... 11-009357

(51) Int. Cl.[7] ..... B01F 3/04

(52) U.S. Cl. ..... 95/245; 96/215; 96/242; 96/296; 96/299; 261/36.1; 261/113

(58) Field of Search ..... 261/36.1, 110, 261/113; 95/159, 165, 166, 170, 221, 245; 96/202, 203, 204, 205, 207, 215, 220, 242, 243, 271, 296, 299, 322, FOR 130

(56) References Cited

U.S. PATENT DOCUMENTS

| | | | | |
|---|---|---|---|---|
| 33,086 | * | 8/1861 | Huwald | 261/113 |
| 441,106 | * | 11/1890 | Monsanto | 96/322 |
| 516,590 | * | 3/1894 | Convert | 261/113 |
| 641,684 | * | 1/1900 | Ferry | 261/113 |
| 980,108 | * | 12/1910 | Lillie | 261/113 |
| 1,040,875 | * | 10/1912 | Burhorn | 261/113 |
| 1,213,342 | * | 1/1917 | Duvall | 96/202 |
| 1,630,575 | * | 5/1927 | Maas | 261/113 |
| 1,739,867 | * | 12/1929 | Seymour | 261/113 |
| 2,558,222 | * | 6/1951 | Parkinson | 261/113 |
| 2,934,326 | * | 4/1960 | Strand | 261/113 |
| 3,748,828 | * | 7/1973 | Lefebvre | 96/296 |

FOREIGN PATENT DOCUMENTS

| | | | |
|---|---|---|---|
| 50-120632 | | 9/1975 | (JP) . |
| 61-28688 | | 7/1986 | (JP) . |
| 6-182108 | * | 7/1994 | (JP) ..... 96/202 |
| 7-152202 | | 6/1995 | (JP) . |
| 9-15902 | | 1/1997 | (JP) . |
| 63-25664 | | 2/1998 | (JP) . |

* cited by examiner

*Primary Examiner*—C. Scott Bushey
(74) *Attorney, Agent, or Firm*—Oliff & Berridge, PLC

(57) ABSTRACT

An apparatus for removing solvents, utilizing a solvent removal unit equipped with an upper liquid supporting member provided with a bottom portion which supports the solvent suspension and which is provided with an opened hole, and a lower liquid supporting member provided at a lower side and at a distance from said upper liquid supporting member, such that the solvent suspension is dropped from the upper liquid supporting member to the lower liquid supporting member, and that the solvent suspension is brought into contact with a gaseous phase while it is being dropped. A method for removing solvents, utilizing a step of dropping a solvent suspension from an upper liquid supporting member provided with a bottom portion which supports the solvent suspension and which is provided with an open hole, to a lower liquid supporting member provided at a lower side and at a distance from said upper liquid supporting member, provided that the solvent suspension is brought into contact with a gaseous phase while it is being dropped.

12 Claims, 4 Drawing Sheets

APPARATUS FOR REMOVING SOLVENTS, SYSTEM FOR REMOVING SOLVENTS, METHOD FOR REMOVING SOLVENTS, AND METHOD FOR PRODUCING TONERS FOR USE IN DEVELOPING ELECTROSTATIC CHARGE IMAGES

TECHNICAL FIELD OF THE INVENTION

The present invention relates to an apparatus, a system, and a method for removing solvents from solvent suspensions such as the suspension of toners for use in developing electrostatic images which contain solvents at their production, and to a method for producing toners for use in developing electrostatic charge images.

BACKGROUND OF THE INVENTION

Recently, in the method for producing fine polymer grains (containing the toners for the electrostatic charge image development for use in developing electrostatic latent images formed by electrophotography and electrostatic recording), there is proposed a method for obtaining the grains by dispersing and suspending a polymer solution (e.g., a mixed solution of toner materials) previously prepared by dissolving the polymer in a solvent in an aqueous medium, and then, by removing the solvent, for instance, by either heating the resulting solvent suspension or reducing the atmospheric pressure under which the solvent suspension is provided (see, for instance, JP-B-Sho61-28688, JP-A-Sho63-25664, JP-A-Hei7-152202, JP-A-Hei9-15902, where the term "JP-B-" signifies "an examined published Japanese patent application" and "JP-A-" signifies "an unexamined published Japanese patent application").

In the methods above, the solvent is removed by drying in the liquid, i.e., the solvent is transferred from the liquid droplet of the polymer component into the aqueous medium, and the solvent in the aqueous medium is gasified at the interface between the suspension and the gas. To effectively promote the gasification of the solvent, it is required that the contact area of the suspension with the gas is increased, that the energy is efficiently provided to the suspension in the form of the heat, and that the gasified solvent is efficiently removed at the evaporating interface.

Furthermore, to maintain the polymer grains to yield a sharp particle size distribution, it is necessary that stress is not applied to the liquid droplets of the polymer component during the stage of removing the solvent; and to keep the uniform shape of the particles, it is further required that no anomalous strain is applied thereto. If a stress is applied to the polymer grains that are still in the form of droplets in the stage before removing the solvent therefrom, the grains easily undergo fission to generate finer grains as to result in a broad particle size distribution. Furthermore, if the droplets of polymer grains are squeezed by an anomalous strain during the process of removing the solvent from the polymer grain droplets at the stage the region of elastic deformation is switched into the region of plastic deformation, the polymer grains maintain their shape as they are to the final stage.

Further, if the rate of exchanging the contact interface between the suspension and the gas should be lower with respect to the rate of removing solvents at the contact interface, a film which suppresses the progressive removal of the solvent is formed at the contact interface between the suspension and the gas. Thus, the exchanging rate should be well comparable to the rate of removing solvents.

Accordingly, to effectively perform the solvent removal from the droplets of polymer component by using the methods above, there is required an increase in the contact area per unit volume of the suspension and the gas, a greater quantity of carrier gas which transports the gasified solvent, and a larger heating area per unit volume of the suspension which is capable of providing a calorific value sufficient to comply with the heat of evaporation. Furthermore, it is also required that the exchanging rate is provided as such that it would sufficiently comply with the rate of removing solvents while minimizing the applied stress and strain.

However, while it is relatively easy in a laboratory based production to satisfy all of the conditions above if a small portion of the polymer component suspension is slowly mixed inside a heated flask in such a manner that a stress would not be applied thereto and the evaporated vapor is removed therefrom, it is practically unfeasible to achieve them in a industrial scale production.

More specifically, in case of using a commercially available flask and a polymerization tank in a laboratory based production, in general, the contact area between the suspension and the gas is, for $10^{-4}$ $m^3$ of the suspension, about 28 $m^2/m^3$ per unit volume of the gas, and for $10^{-3}$ $m^3$ of the suspension, it is about 11 $m^2/m^3$ per unit volume of the gas. In a bench size or a pilot equipment size production, the contact area is about 11 $m^2/m^3$ per unit volume of the gas for $10^{-2}$ $m^3$ of the suspension, and is about 2 $m^2/m^3$ per unit volume of the gas for $10^1$ $m^3$ of the suspension. In case of performing the process in an industrial base, however, the contact area is about 0.8 $m^{2/3}$ per unit volume of the gas for 1 $m^3$ of the suspension, about 0.4 $m^{2/3}$ per unit volume of the gas for 10 $m^3$ of the suspension, and is about 0.2 $m^{2/3}$ per unit volume of the gas for 80 $m^3$ of the suspension. It can be seen therefrom that the contact area between the suspension and the gas per unit volume decreases with increasing amount of the suspension to be processed, and the heating area per unit volume similarly decreases. Should other processing conditions, for instance, the temperature, the pressure, etc., be set the same, the time necessary for removing the solvent from the suspension increases, as compared with the case of removing a solvent of $10^{-4}$ $m^3$, to 6 times for removing a solvent from a suspension of $10^{-2}$ $m^3$; to 14 times, to 35 times, to 70 times, and to 140 times as the volume of the suspension increases to $10^{-1}$ $m^3$, to 1 $m^3$, to 10 $m^3$, and to 80 $m^3$ respectively.

As an apparatus for increasing the contact area between the solution and the gas, there can be used a commercially available apparatus, for instance, a thin film evaporation apparatus-, a thin film defoaming apparatus, a packed tower, a gas-liquid counter flow contact apparatus, etc. However, even if the apparatus above should be used in removing the solvent, the efficiency lowers due to the decrease in the contact area between the solution and the gas per unit volume of the suspension as compared with the case of a laboratory based production scale if the amount of suspension increases, and also, it is still impossible to avoid the stress and the strain from being applied to the suspension. Furthermore, although there is proposed a method of efficiently increasing the contact area with the gas by spraying the suspension, this method also is not free from the large stress that is applied to the suspension.

In addition to the methods of drying in a liquid as described above, there is proposed a method of directly drying the suspension, and as the apparatus for use in drying the slurry suspension, there can be used a commercially available apparatus such as a spray drier, a flush drier, etc. In this method, it is necessary to dry the water used as the medium. Accordingly, the suspension is generally brought into contact with a gas at a temperature of 100° C. or higher.

However, in such a case, there are disadvantages as such that the heat efficiency becomes low due to the increase in size of the apparatus as compared with the amount to be processed, and that the operation cost becomes extremely high. Furthermore, as an apparatus for use in the method other than that of directly drying the suspension, there can be mentioned a commercially available apparatus such as a vibration drier, a floating bed drier, a paddle drier, and a steam tube drier. However, they are, by principle, unfeasible for use in the method above, because these apparatuses are designed for drying cake-like materials.

Concerning another aspect of the present invention, i.e., the method of producing the fine polymer grains containing the toners for the electrostatic charge image development for use in developing electrostatic latent images formed by electrophotography and electrostatic recording, there are several methods known in the art. Such methods include the methods of directly producing fine polymer grains from monomers used as the starting materials, by utilizing polymerization reactions such as a suspension polymerization, an emulsion polymerization, a seed polymerization, or a dispersion polymerization. However, the fine polymer grains that are produced by the polymerization methods above suffer problems, such that there is a difficulty in removing the residual monomers and the surfactants; that there is a difficulty in incorporating an insoluble material such as a colorant, an antistatic controller, a surface lubricant, etc.; that the available type of polymers and the available particle size range of the grains are limited; and that the optimal conditions for preparing the grains need to be studied every time the material composition is changed.

In addition, there are methods of preparing the fine polymer grains by finely dividing a polymer that is prepared beforehand by means of a polymerization reaction. Among them, the method of melt kneading and grinding comprises subjecting a coarsely crushed polymer to grinding using a finely grinding machine such as of a mechanical rotation type or a jet type, followed by classifying the resulting ground product to obtain the fine polymer grains, and is a most frequently used production method for obtaining the toners for use in developing electrostatic images. However, the fine polymer grains that are obtained by this method is heterogeneous, and moreover, the grain size is not uniform. Hence, the fine polymer grains obtained by this method suffers disadvantages as such that, for instance, it requires a classification process to obtain particles with size distribution falling in a narrow range.

There is also known a method for obtaining particles which comprises preparing a polymer solution by dissolution into a solvent, and then mist-spraying the resulting polymer solution. However, the fine polymer grains that are produced by this method are not free from disadvantages as such that a uniform grain size cannot be obtained, and that the apparatus for production becomes too large.

Similarly, there also is known a method of adding a poor solvent into a polymer solution previously prepared by dissolution into a solvent, or by cooling the polymer solution previously prepared by heating and dissolution into a solvent, thereby obtaining the fine polymer grains by precipitation. However, this method is disadvantageous in that it is difficult to control the shape of the resulting grains and that the grain diameter are not uniform.

Further, there is known a method comprising dispersing a heated and molten polymer in a medium heated to a temperature not lower than the melting point of the polymer, and then cooling the resulting dispersion to obtain fine polymer grains (see, for instance, JP-A-Sho50-120632, etc.). However, in case an aqueous medium is used in this method, almost all cases require applying pressure, and in case an oil medium is used, it suffers difficulty in, not only cleaning, but also in controlling the shape of the grains.

Recently, from the viewpoint of various advantages such that it has no residual monomers, that it does not use surfactants and that it thereby does not require the removal thereof, that insoluble materials such as colorants, antistatic controllers, lubricants, etc., can be easily incorporated, that it does not require re-examination of the optimal conditions for granularization even in case the material composition is changed, that a sharp particle size distribution is obtained, and that the aqueous medium can be easily cleaned up, recently proposed is a method of producing the grains as described above, comprising dispersing and suspending, in an aqueous medium, a polymer solution (a mixed solution of the toner material and the like) which is prepared beforehand by dissolution in a solvent and then removing the solvent therefrom by, for instance, heating the system or by reducing the pressure (see, for instance, JP-B-Sho61-28688, JP-A-Sho63-25664, JP-A-Hei7-152202, JP-A-Hei9-15902, etc.).

Even in the production method above regarded as the most favorable one among the conventional methods from the viewpoint of increasing the toner performance and the suitability in production, when scaled up to an industrial size, it also suffers difficulty in the solvent removal process due to the reason described hereinbefore.

SUMMARY OF THE INVENTION

The present invention has been accomplished in the light of the circumstances above.

More specifically, the present invention provides an apparatus, a system, and a method for removing solvents from a suspension containing a solvent at high efficiency without impairing the particle size distribution and the shape of the grains, thereby enabling polymer grains at high production efficiency.

The present invention also provides a method for producing toners for use in developing electrostatic images by using the apparatus, the system, and the method for removing solvents from a solvent suspension containing the toner material, at a high efficiency, and yet, without impairing the particle size distribution and the shape of the grains.

Accordingly, the present inventors intensively studied a method for removing the solvent from a solvent suspension obtained by dispersing the mixed solvent solution in an aqueous medium, and, as a result, in removing the solvent from the solvent suspension, they have found that, by bringing the solvent suspension in contact with a gas under predetermined conditions, the grains of toners for use in developing electrostatic images can be obtained with a sharp particle size distribution and with a uniform shape, while yet greatly shortening the time necessary for removing the solvent. The present invention has been achieved based on these findings.

That is, the apparatus for removing solvents according to the present invention is characterized in that it comprises a solvent removal unit equipped with an upper liquid supporting member provided with a bottom portion which supports the solvent suspension and which is provided with an opened hole, and a lower liquid supporting member provided at a lower side and at a distance from said upper liquid supporting member, such that the solvent suspension is dropped from the upper liquid supporting member to the lower liquid supporting member, and that the solvent suspension is brought into contact with a gaseous phase while it is being dropped.

Preferably, the lower liquid supporting member comprises an opened hole in the bottom portion thereof, and preferably, the solvent suspension is dropped in such a manner that it comprises at least a columnar portion during it is being dropped in the aforementioned solvent removal unit.

Furthermore, the diameter of the hole provided in the bottom portion of the liquid supporting member above is preferably set as such that the flow rate of the solvent suspension per single hole is 400 cc/min or lower.

Further, the liquid supporting member provided inside the solvent removal unit above is placed horizontally, and that the liquid supporting member is set vertically in a plurality of stages.

Yet further, a porous member or a tube made of a porous member capable of discharging a gas is provided at the lower side of the liquid supporting member.

Moreover, it is preferred that a processing solution supply mechanism, which uniformly supplies the solvent suspension, is provided on the uppermost stage of the liquid supporting member, and also preferred is that a gas discharge tube is provided inside a vessel together with the solvent removal unit.

The solvent removal system according to the present invention is characterized in that it comprises the solvent removal apparatus above, a liquid receiving vessel equipped with a stirring means, and a heat exchanger, provided with a line for circulating the solvent suspension among them.

The solvent removal method according to the present invention is characterized in that it comprises a step of dropping a solvent suspension from an upper liquid supporting member provided with a bottom portion which supports the solvent suspension and which is provided with an open hole, to a lower liquid supporting member provided at a lower side and at a distance from said upper liquid supporting member, and that the solvent suspension is brought into contact with a gaseous phase while it is being dropped.

In the gas-liquid interface during dropping the solvent suspension above, the solvent is removed by bringing the solvent suspension into contact with the gas phase under a wind velocity in a range of from 0.1 m/sec to 5 m/sec.

In removing the solvent from the solvent suspension, the solvent suspension is preferably dropped from a height of 50 cm or lower.

Furthermore, it is preferred that the method comprises a step of stirring the solvent suspension after the step of removing the solvent, and that the peripheral velocity of stirring during the step of stirring is set at 70 m/min or lower.

The method of producing the toner for use in electrostatic charge image development according to the present invention is characterized in that the solvent suspension used in the method of removing the solvent contains toner grains.

Further, it is preferred that the method of producing toners for use in developing electrostatic charge images according to the present invention comprises a mixing step of dissolving or dispersing a binder resin or a colorant in a solvent, a step of obtaining a dispersion suspension by dispersing and suspending the mixed solution obtained in the mixing step above into an aqueous medium, and a step of removing the solvent from the thus obtained dispersed suspension.

Moreover, in the gas-liquid interface of the dispersed suspension, the solvent is preferably removed by bringing the suspension into contact with the gas phase under a wind velocity in a range of from 0.1 m/sec to 5 m/sec.

Furthermore, it is preferred that, in removing the solvent from the dispersed suspension, the solvent suspension is dropped from a height of 50 cm or lower.

Yet additionally, it is preferred that the method comprises a step of stirring the dispersed suspension after the step of removing the solvent, provided that the peripheral velocity of stirring during the step of stirring is set at 70 m/min or lower.

BRIEF EXPLANATION OF THE DRAWINGS

Preferred embodiments of an apparatus for removing solvents and a method for removing solvents and an apparatus and method for producing a toner utilizing the removing method according to the present invention will be described in detail based on the drawings.

DESCRIPTION OF THE PREFERRED EMBODIMENTS

The present invention is described in further detail below by making reference to preferred embodiments.

The principal portion of the apparatus for removing solvents according to the present invention is constructed by a member which divides the solvent suspension and assures a contact portion with a gas, and a member which efficiently brings the divided solvent portion into contact with a carrier gas. The size and the number of stages of the liquid supporting member which divides the solvent suspension are determined in accordance with the amount of the solvent suspension to be processed.

The apparatus for removing solvents according to the present invention are constructed by providing the members above inside a cylindrical vessel equipped with a gas discharge tube in plurality depending on the amount of the solvent suspension to be processed, and by further providing a heating portion on the liquid supply line led to the liquid supporting member.

Figure 1:
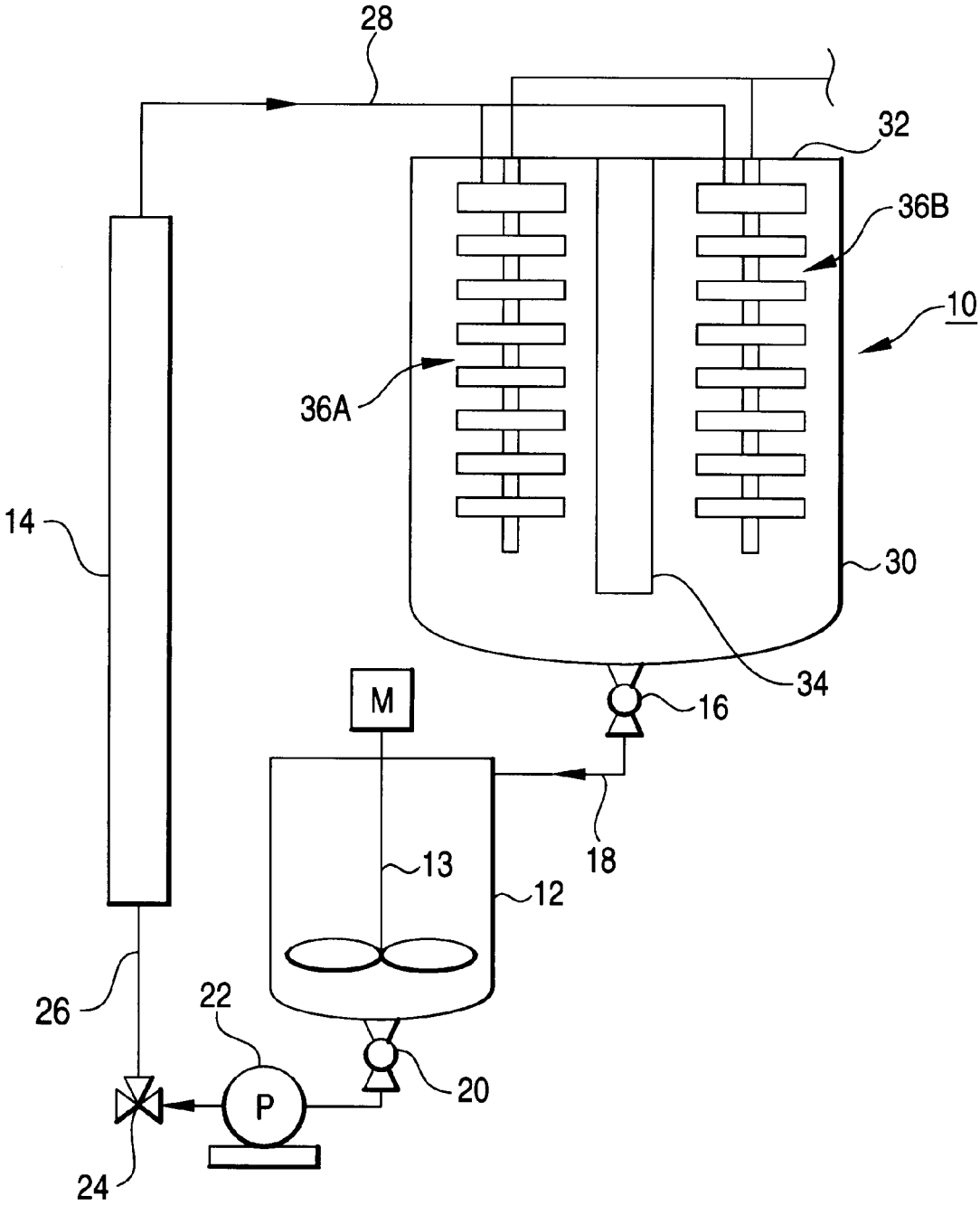
FIG. 1 is a schematically drawn structural side view showing an example of the constitution of a system for removing solvents according to the present invention, it is the upper plane schematic diagram showing an example of a liquid supporting member.

In FIG. 1 is provided an entire constitution of an embodiment of the system for removing solvents according to the present invention. The system for removing solvents is mainly constructed by an apparatus for removing solvents 10, a tank for receiving the processing liquid 12, and a double pipe type heat exchanger 14, in which the apparatus for removing solvents 10 and the tank for receiving the processing liquid 12 are connected with a pipe 18 equipped with a switching valve 16. The tank for receiving the processing liquid 12 and the double pipe type heat exchanger 14 are connected with each other with a pipe 26 equipped with a switching valve 20, a liquid transport pump 22, and a three way valve 24. The double pipe type heat exchanger 14 is connected with the apparatus for removing solvents 10 with a pipe 28. Thus, the solvent suspension can be circulated among the apparatus for removing solvents 10, the tank for receiving the processing liquid 12, and the double pipe type heat exchanger 14.

The apparatus for removing solvents 10 comprises a cylindrical casing 30 having an upper lid 32 which can be freely opened and shut. To the central portion of the cylindrical casing 30 is provided a gas discharge tube 34 having an open lower end, and the gas discharge tube 34 communicates with a gas discharge tube (not shown) provided to the outer side of the casing 30. Furthermore, solvent removal units 36A and 36B are provided inside the casing 30.

Figure 2:
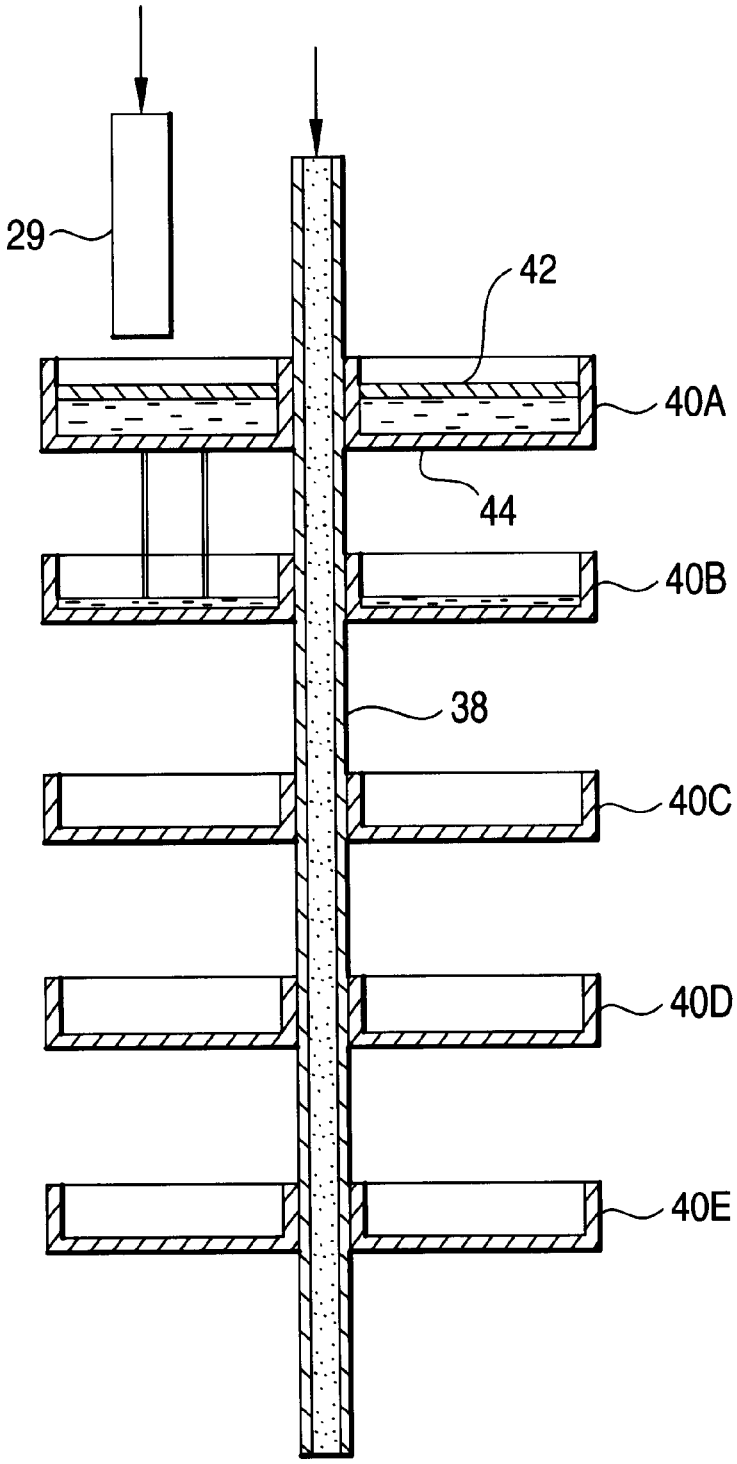
FIG. 2 is a schematically drawn structural planar view showing an example of a solvent removal unit included in the apparatus for removing solvents according to the present invention, it is the side plane schematic diagram showing an example of a liquid supporting member.
Figure 3:
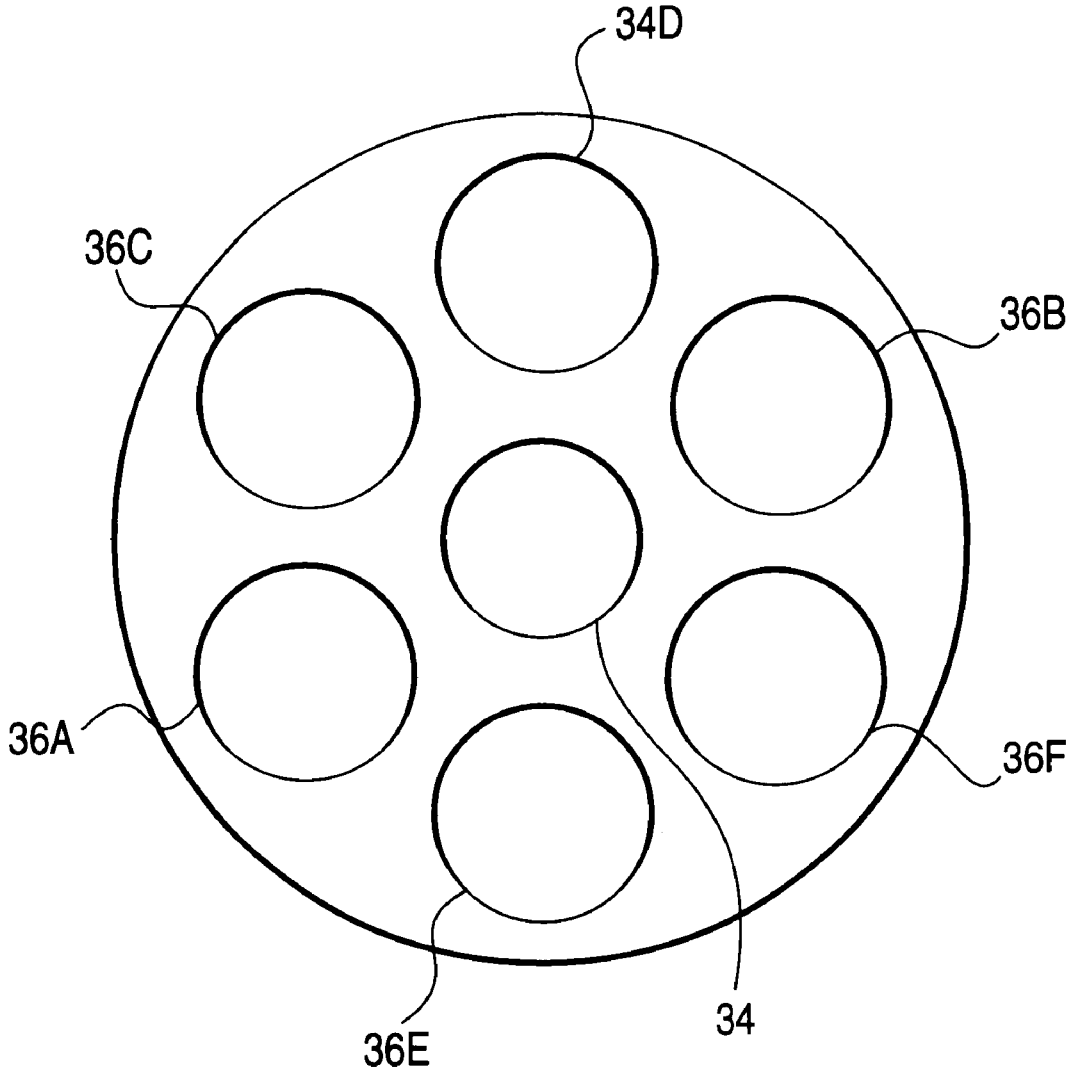
FIG. 3 is a schematically drawn side view showing the inside of the casing used in the apparatus for removing solvents according to the present invention.

FIG. 2 is a schematically drawn planar view of the inside of the casing 10 shown in FIG. 1. Referring to FIG. 2, solvent removal units 36C, 36D, 36E, and 36F are provided in symmetrical and equi-spaced arrangement around the gas discharge tube 34 in addition to the solvent removal units 36A and 36B. Furthermore, although not shown in the figure, pipes 28 are each connected to each of the solvent removal units in order to supply the solvent suspension, and inert gas supply nozzles 38 are each connected thereto.

Figure 4:
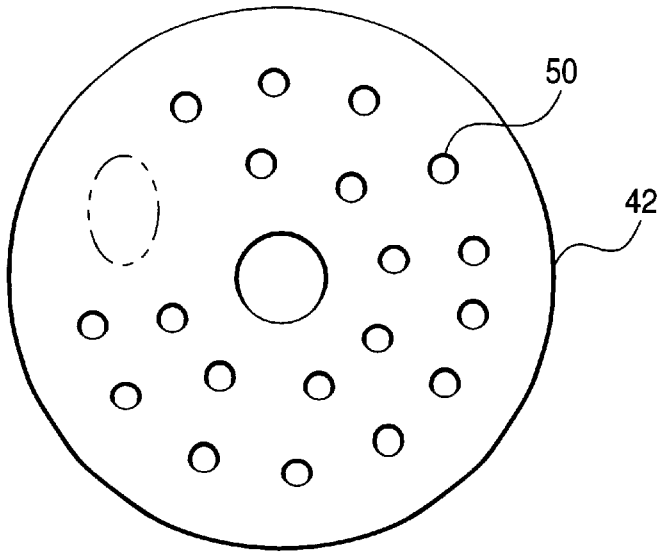
FIG. 4A and FIG. 4B are each a planar view showing the disk of a liquid supporting member of the solvent removal unit included in the apparatus for removing solvents according to the present invention.
FIG. 4C is a side cross section diagram of the liquid supporting member.
Figure 4:
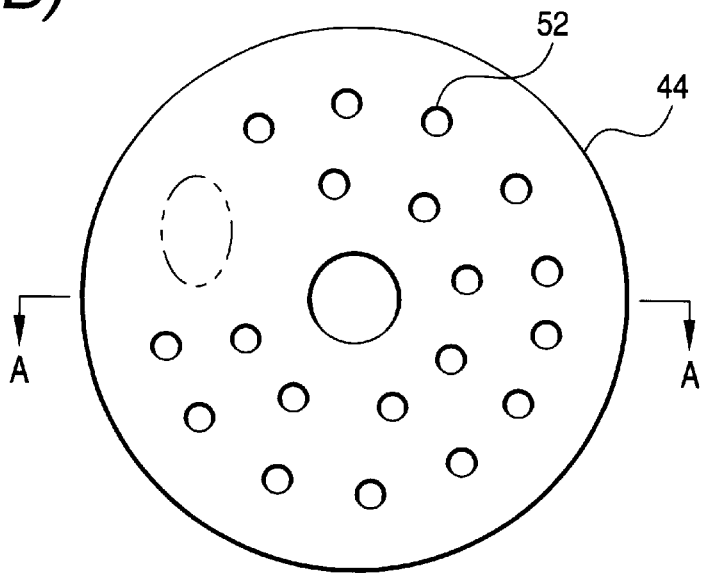
Figure 4:
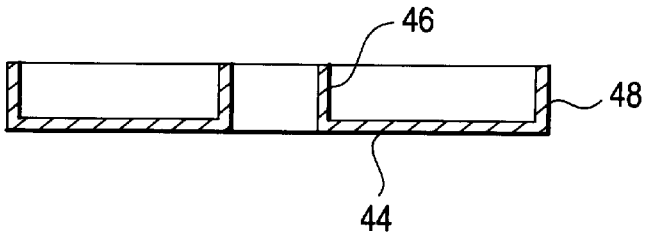

FIG. 2 shows a schematically drawn constitution of a preferred embodiment of the solvent removal unit. Referring to FIG. 2, the solvent removal units each comprise a gas blower member 38 at the center thereof, and liquid supporting members 40A, 40B, 40C, 40D, and 40E are set equi-spaced by taking a predetermined distance one another in the direction of the axis of the gas blower member 38. The liquid supporting member 40A comprises a disk 42 shown in FIG. 4A and a disk 44 shown in FIG. 4B both fixed to a hub 46. As shown in FIG. 4C, a ring-like side wall 48 is provided to the peripheral edge of the disks 42 and 44. By thus fixing the liquid supporting member 40A to the gas blower member 38 via the hub 46, a region for temporarily reserve a liquid is formed between the disk 42 and the other disk 44, so that the solvent suspension can be supplied uniformly downward.

The gas blower member 38 is made of a porous member or a perforated member. As the porous member, there can be mentioned a pipe, etc., made from a sintering comprising a plurality of entraining pores provided in a direction as such that they may cross orthogonally as much as possible to the longitudinal direction of the gas blower member. As the perforated members, there can be exemplified a plastic, a metallic, or a like pipe, having perforated fine pores in a direction orthogonal to the axial direction of the pipe.

The disk 42 provided to the liquid supporting member 40A comprises a plurality of holes 50 through which the solvent suspension may be dropped downward, while the lower side portion (i.e., the hatched region) of the pipe 28 that is provided to the upper portion of the disk 42 is provided free from holes. A plurality of holes 52 are provided to the disk 44 in such a manner that the positions of the holes 50 provided to the disk 42 are displaced from the holes 52 provided to the disk 44. In the disk 44, furthermore, the position of the holes located in the vicinity of the hub 46 are set as such that they sequentially make a zigzag arrangement with the holes 50 neighboring thereto.

The liquid supporting members 40B, 40C, 40D, and 40E are not provided with any disks as such corresponding to the disk 42 of the liquid supporting member 40A, but are provided with the disks 44. Furthermore, the holes provided to the liquid supporting member 40A are displaced from those provided to the liquid supporting member 40B; similarly, the holes provided to the liquid supporting member 40B are displaced from those of the liquid supporting member 40C, those of the liquid supporting member 40C are displaced from those of the liquid supporting member 40D, and those of the liquid supporting member 40D are displaced from those of the liquid supporting member 40E.

The apparatus for removing solvents and the system for removing solvents described above are each an example of the preferred embodiments; thus, the size of the disk, the number of holes formed on the disk, the number of stages of the liquid supporting member, and the distance among the liquid supporting members can be changed as desired depending on the type and the amount of the solvent dispersion.

In the present invention, the solvent suspension preferably is set as such that it is dropped downward without being substantially brought into contact with the other members placed lower than the liquid supporting member, and that it comprises at least a columnar portion. Thus, the hole diameter and the distance among the liquid supporting members and the like are selected by taking the above requirements into consideration. By "dropping downward without being substantially brought into contact with the other members placed lower than the liquid supporting member", there should be excluded an embodiment as such that the solvent suspension runs down along a certain member between the liquid supporting member and the member provided lower than that. Although the solvent suspension is allowed to partially run down by making a thin liquid film between the liquid supporting member and the other liquid supporting member provided to the lower side thereof, the other portion accounting for the most part of the solvent suspension fall down in the form of a column. Furthermore, "that it comprises at least a columnar portion" means that the region which falls in such a manner that it comprises a columnar portion accounts for a large portion, and in the rest of the region, there may be a portion which runs down along the other member by making a thin film, or a portion which falls down in the form of droplets.

Thus, the diameter of the holes formed on the disk, the distance between the liquid supporting members, etc., are selected as such that the solvent suspension may fall down in a state satisfying the above requirements.

Then, a preferred embodiment for carrying out the method for removing solvents based on the aforementioned apparatus for removing solvents and the system for removing solvents is described below.

The solvent suspension is charged inside a tank for receiving the processing liquid 12, and is fed to each of the solvent removal units 36A, 36B, 36C, 36D, 36E, and 36F provided inside the apparatus for removing solvents 10 via a liquid transportation pump 22. To increase the efficiency of removing the solvent inside the apparatus for removing solvents 10 in this case, thermal energy is provided to the solvent suspension by using the double pipe heat exchanger 14. The quantity of thermal energy supplied in this case is selected as desired depending on, for instance, the type of the solvent suspension.

In the solvent removal units 36A, 36B, 36C, 36D, 36E, and 36F, the solvent suspension is supplied from the solvent suspension supply nozzle 29, as indicated by a black arrow. After spreading on the disk 42 of the liquid supporting member 40A, the solvent suspension runs down uniformly onto the disk 44 through the hole 50 provided to the disk 42, and is stored temporarily on the liquid supporting member 40A.

Then, the solvent suspension stored on the liquid supporting member 40A falls down uniformly in the form of columns through each of the holes 52 formed in the disk 44 onto the liquid supporting member 40B placed just under the disk 44. In this manner, the liquid supporting member 40A functions as a solvent suspension supply mechanism which relaxes the flow energy in supplying the solvent suspension to the solvent removal unit while providing the potential energy as the principal energy for driving down the solvent suspension. Accordingly, the solvent suspension uniformly falls down sequentially onto the liquid supporting member 40C, liquid supporting member 40D, and liquid supporting member 40E in the form of columns free from any stress. During this process, gas is ejected radially from the gas ejecting holes of the gas blower member 38 made of a porous member or a perforated member, and is brought efficiently in contact with the solvent suspension falling down in columns. Thus, the gas-liquid interface is constantly replaced by a fresh gas, and a most efficient solvent removal is realized in the solvent suspension.

In the process above, preferably, the solvent suspension is passed through the hole provided to the liquid supporting member at a flow rate of 400 cc/min or lower, and to maintain the form of the solvent suspension described below, the flow rate is, most preferably, in a range of from 10 cc/min or higher but not higher than 400 cc/min. If the flow rate exceeds 400 cc/min, the impact force applied to the solvent suspension on falling down becomes too large, and is not preferred because the grains suspended in the solvent suspension is finely divided. If the flow rate is lower than 10 cc/min, it is not preferred because the solvent suspension cannot maintain the columnar shape, and forms droplets that are subject to stress.

Further, concerning the morphology of the solvent suspension during the process of falling down, it is preferred that the solvent suspension falls in a shape having at least a columnar portion from the viewpoint that less impact force is applied to the solvent suspension during its falling down, that a larger contact area is achieved between the solvent suspension and the gas, that the solvent suspension is stable with respect to the gaseous phase blown thereto, and that less gas is incorporated into the liquid and thereby foaming is suppressed in the solvent suspension, etc.

Furthermore, the use of the gas blower member 38 made of a porous member or a perforated member allows the solvent to be evaporated from the gas-liquid interface of the solvent suspension and thereby efficiently promotes the removal of the solvent, while uniformly blowing the carrier gas against the solvent suspension without applying any stress to the solvent suspension. The gas that is ejected from the gas blower member 38 is selected depending on the type of the solvent suspension, and it is not preferred to use such gases which forms a compound with the component of the solvent suspension or which causes the denaturation of the component included in the solvent suspension; preferably used is an inert gas. The gas (inert gas) ejected from the gas blower member 38 transports the vaporized solvent removed from the solvent suspension to the outside via the gas discharge tube 34. Then, the inert gas is separated from the vaporized solvent by a separator (not shown), and is recovered, and supplied again to the gas blower member 38. Because the gas discharge tube 34 is provided inside the cylindrical casing 30 to discharge the gas from the lower end portion thereof, there are advantages as such that it prevents the exterior contamination attributed to the evaporated solvent vapor, that it enables the recovery of the solvent, and that it promotes the evaporation of the solvent suspension provided on the liquid supporting member by eliminating the short pass of the carrier gas.

The solvent suspension from which the solvent is removed is stored in the bottom portion of the apparatus for removing solvents 10, and then introduced to the tank for receiving the processing solution 12. In the tank for receiving the processing solution 12, the solvent suspension is stirred by means of a stirring paddle 13. However, because a stress is applied to the solvent suspension if the stirring paddle is operated at a high peripheral velocity, it is preferred that the peripheral speed is set to 70 m/min or lower.

The solvent suspension inside the tank for receiving the processing solution 12 is transferred to the double pipe type heat exchanger 14 via the liquid transport pump 22. In the double pipe type heat exchanger 14, thermal energy is applied to the solvent suspension to increase the efficiency of solvent removal so long as the energy does not impair the properties of the components included in the solvent suspension. The solvent suspension heated in the double pipe type heat exchanger 14 is introduced again to each of the solvent removal units. When a desired quantity of solvent is removed from the solvent suspension by conducting this sequence of operations, the three way valve 26 is operated to take out the solvent-removed processed solution from the line.

Then, the method for producing the toner for use in the electrostatic charge image development according to the present invention is described in detail below. As described above, although various types of methods can be mentioned as the method for producing the toner for use in the electrostatic charge image development comprising a step of solvent removal, as a representative example, the details are given below for a method for producing the toner for use in the electrostatic charge image development comprising a mixing step of dissolving or dispersing a binder resin and a colorant in a solvent, a step of obtaining the dispersed suspension comprising adding the mixed solution in the mixing step into an aqueous medium and then dispersing and suspending the resulting mixed solution, and a step of removing the solvent from the thus obtained dispersed suspension.

The process steps of the method for producing the toner for use in the electrostatic charge image development above is described sequentially below.

The first step of the method according to the present invention is a mixing step comprising mixing the toner materials in a solution to obtain a mixed solution of the toner materials. In the mixing step, a toner material containing at least a binder resin and a colorant is dissolved or dispersed in a solvent to obtain a mixed solution of the toner material.

The toner material may properly contain if necessary, in addition to the binder resin and the colorant, an additive commonly incorporated into the toner grains, such as a lubricant, an antistatic controller, etc. The mixed solution of the toner material may be prepared by dissolving or dispersing a product previously obtained by kneading a binder resin with a colorant, a lubricant, an antistatic controller, etc. Otherwise, it can be prepared by dispersing a colorant, a lubricant, an antistatic controller, etc., into a solution obtained by dissolving the binder resin in a solvent, by using a disperser equipped with a media, such as a ball mill, sand mill, etc., or by means of a high pressure disperser and the like. In the mixing step above, any type of method can be employed so long as the binder resin is dissolved in the solvent and the colorant is dispersed in the solution.

There is no particular limitation for the binder resin for use in the toner for use in the electrostatic charge image development according to the present invention, and usable are the resins commonly used as the toner resins. Specifically mentioned as the toner resins are polyester resins, styrene resins, acrylic resins, styrene-acrylic resins, silicone resins, epoxy resins, diene-type resins, phenolic resins, ethylene-vinyl acetate resins, etc. More preferred among them from the viewpoint of fusibility at fixing and the smoothness of the available image are the polyester resins.

As the polymerization monomer for use in the polyester resins, mentioned are the following. As the alcoholic component, there can be used the diols such as polyoxypropylene (2,2)-2,2-bis(4-hydroxyphenyl)propane, polyoxypropylene (3,3)-2,2-bis(4-hydroxyphenyl)propane, polyoxyethylene (2,0)-2,2-bis(4-hydroxyphenyl) propane, polyoxypropylene (2,0)-polyoxyethylene (2,0)-2,2-bis(4-hydroxyphenyl) propane, etc.; and ethylene glycol, diethylene glycol, triethylene glycol, polyethylene glycol, propylene glycol, dipropylene glycol, isopentyl glycol, hydrogenated bisphenol A, 1,3-butanediol, 1,4-butanediol, neopentyl glycol, xylylene glycol, 1,4-cyclohexanedimethanol, glycerol, trimethylolethane, trimethylolpropane, pentaerythritol, bis-(β-hydroxyethyl) terephthalate, tris-(β-hydroxyethyl) isocyanurate, 2,2,4-trimethylolpentane-1,3-diol, etc. Furthermore, a hydroxycarboxylic acid component can be added to the alcoholic components above to impart additional properties to the polyester resin.

For example, there can be added p-oxybenzoic acid, vanillic acid, dimethylol propionic acid, malic acid, tartaric acid, 5-hydroxyisophthallic acid, etc.

As specific examples for the acidic components, there can be mentioned, for example, malonic acid, succinic acid, glutaric acid, dimeric acid, phthalic acid, isophthalic acid, terephthalic acid, dimethyl isophthalate, dimethyl terephthalate, monomethyl phthalate, tetrahydroterephthalic acid, methyltetrahydrophthalic acid, hexahydrophthalic acid, dimethyltetrahydrophthalic acid, endomethylenehexahydrophthalic acid, naphthalenetetracarbic acid, diphenolic acid, trimellitic acid, pyromellitic acid, trimesic acid, cyclopentanedicarboxylic acid, 3.3',4,4'-benzophenonetetracarboxylic acid, 1,2,3,4-butanetetracarboxylic acid, 2,2-bis-(4-carboxyphenyl) propane, diimidecarboxylic acids obtained from trimellitic anhydride and 4,4-diaminophenylmethane; and polyimidecarboxylic acids having isocyanate rings obtained from trimellitic acid anhydrides with tris-(β-carboxyethyl) isocyanurate, polyimidecarboxylic acid having isocyanurate rings, or the trimmer reaction products of tolylene diisocyanate, xylylene diisocyanate, or isophorone diisocyanate. These acid components are used either singly, or as a combination of two or more types selected therefrom. Among them, the use of the trivalent or higher polyvalent carboxylic acids or polyhydric alcohol as the crosslinking components are preferred from the viewpoint of stability such as the fixing strength and resistances against offset printing.

The polyester resins are obtained from the starting materials above in accordance with a commonly known method. It is preferred that the glass transition temperature is set in the temperature range of from 40 to 80° C., and more preferably, in the range of from 50 to 70° C. As the resin for use in the present invention, two or more types of the aforementioned polyester resins can be used in combination, or, so long as the effect of the present invention is not impaired, other resins can be used in combination therewith. As the usable other resins, there can be mentioned styrene resins, acrylic resins, styrene-acrylic resins, silicone resins, epoxy resins, diene-type resins, phenolic resins, terpene resins, coumalin resins, amide resins, amide-imide resins, butyral resins, urethane resins, ethylene-vinyl acetate resins, etc. In the present inventions, the resins other than the polyester resin used as the principal component are preferably added in the toner in an amount of from 0 to 30 part by weight.

In the present invention, colorants can be dispersed in the thermoplastic resin above, and usable are the known organic or inorganic pigments and dyes, or oil-soluble dyes. For instance, there can be used C. I. Pigment Red 48:1, C. I. Pigment Red 57:1, C. I. Pigment Red 122, C. I. Pigment Yellow 17, C. I. Pigment Yellow 47, C. I. Pigment Yellow 12, C. I. Pigment Blue 15:1, C. I. Pigment Blue 15:3, Lump Black (C. I. No.77266), Rose Bengal (C. I. No.45432), carbon black, nigrosine dye (C. I. No.50415B), metal complex salt dyes, derivatives of metal complex salt dyes, and mixtures thereof. Furthermore, there can be used various types of metal oxides such as silica, aluminum oxide, magnetites and other ferrites, copper oxide, nickel oxide, zirconium oxide, titanium oxide, magnesium oxide, etc., and proper mixtures thereof.

The colorants above must be contained in an amount sufficient to form a visible image having a sufficient color density. Although depending on the particle diameter of the toner and the degree of development, in general, the colorants are properly added in a range of from 1 to 100 parts by weight with respect to 100 part by weight of toner.

In the present invention, an antistatic controller may be added if necessary. Usable antistatic controllers include those used in powder toners; i.e., a compound selected from the group consisting of the metallic salts of benzoic acid, metallic salts of salicylic acid, metallic salts of alkylsalicylic acid, metallic salts of catechol, metal-containing bisazo dyes, tetraphenylboratederivatives, quaternaryammonium salts, and alkylpyridinium salts. Also usable preferably are the combinations of the compounds above.

The amount of addition of the antistatic controllers above with respect to the toner is, in general, in a range of from 0.1 to 10% by weight, and more preferably, in a range of from 0.5 to 8% by weight. If the amount of addition should be lower than 0.1% by weight, the effect of antistatic control becomes insufficient, whereas an addition of more than 10% by weight excessively lowers the toner resistance as to make the toner unfeasible for practical use.

In addition to the antistatic controllers above, there can be used a metallic soap or an inorganic or organic salt. As the metallic soaps, there can be mentioned aluminum tristearate, aluminum distearate, stearic acid salts of barium, calcium, or zinc; linoleic acid salts of cobalt, manganese, lead, or zinc; octoic acid salts of aluminum, calcium, or cobalt; oleic acid salts of calcium or cobalt; zinc palmitate, naphthenic acid salts of calcium, cobalt, manganese, lead, or zinc; and resin acid salts of calcium, cobalt, manganese, lead, or zinc. As the inorganic or organic metallic salts, there can be mentioned the salts comprising cationic components selected from the group of metals consisting of those belonging to the Group Ia, Group IIa, and Group IIIa of the periodic table, and anionic components of the acids being selected from the group consisting of halogens, carbonates, acetates, sulfates, borates, nitrates, and phosphates. Those antistatic controller aids or the cleaning aid agents are added in an amount of, in general, from 0.1 to 10% by weight with respect to the toner, and more preferably, in a range of from 0.1 to 5% by weight. An amount of addition falling out of this range is not preferred; if the amount of addition should be lower than 0.1% by weight, the desired effect becomes insufficient, whereas an addition in excess of 10% by weight brings about a loss of fluidity of the toner powder and the like.

In the present invention, usable as the solvent for use in dissolving or dispersing the toner material are the ester type solvents such as methyl acetate, ethyl acetate, propyl acetate, and butyl acetate; the ether type solvents such as diethyl ether, dibutyl ether, and dihexyl ether; ketone type solvents such as methyl ethyl ketone, methyl isopropyl ketone, methyl isobutyl ketone, and cyclohexanone; hydrocarbon solvents such as toluene, xylene, and hexane; and halogen-containing hydrocarbon solvents such as dichloromethane, chloroform, and trichloroethylene. Preferred as the solvents are such capable of dissolving the binder resin, and which dissolves in water at a concentration of from 0 to about 30% by weight. Furthermore, in view of using it in an industrial base, the safety in operation, cost, productivity, etc., must be taken into consideration. Thus, it is particularly preferred to use cyclohexane in combination with polyolefin used as the binder resin, and to use ethyl acetate in combination with the other binder resins. The solvents are incorporated as such that the mixed solution of the toner material yield a viscosity in a range of 1 to 10000 mPa·s, and preferably, in a range of from 1 to 2000 mPa·s at 20° C.

The second step in the method according to the present invention is the dispersing and suspending process which disperses and suspends the mixed solution of the toner material. In the dispersing and suspending process, the mixed solution of the toner material obtained in the mixing step above is introduced into an aqueous medium to obtain a suspension.

As the aqueous medium for use in the above process, it is preferred to use water containing dispersed therein an inorganic dispersant. Furthermore, to obtain a uniform particle size distribution for the toner grains, a high molecular dispersant is preferably added together with the dispersed inorganic dispersant. The inorganic dispersant is dispersed in water by using a disperser utilizing a medium, such as a ball mill, or a high pressure disperser, ultrasonic disperser, etc. The high molecular dispersant can be added to the water by any means, so long as it can be uniformly dissolved in the water. The water for use in the present invention is, in general, an deionized water, distilled water, or pure water.

As the inorganic dispersant above, it is preferred to use a hydrophilic dispersant. More specifically, there can be mentioned silica, alumina, titania, calcium carbonate, magnesium carbonate, calcium triphosphate, clay, diatomaceous earth, bentonite, etc. The inorganic dispersants enumerated above preferably consist of particles whose surface is covered with a polymer having a carboxylic group. Stable toner grains can be produced by using such dispersants consisting of particles having a surface covered with such polymers. As the polymers having a carboxylic group, it is preferred to use those having a number average molecular weight in a range of from 1000 to 200,000; for instance, there can be mentioned an acrylic resin, a methacrylic resin, a fumalic resin, a maleic resin, etc., as the representative examples. The polymer may be a homopolymer of the constituent monomers of these resins, i.e., acrylic acid, methacrylic acid, fumalic acid, maleic acid, etc., or a copolymer of these constituent monomers, or a copolymer of these constituent monomers with vinyl monomer. The carboxylic group may be a metallic salt of sodium, potassium, magnesium, etc.

The usable inorganic dispersants above consist of particles having a mean diameter in a range of from 1 to 1,000 nm, and preferably, in a range of from 5 to 100 nm. The amount of addition of the inorganic dispersants above is in a range of from 1 to 500 part by weight, and preferably, in a range of from 10 to 200 parts by weight with respect to 100 parts by weight of the toner.

As the high molecular dispersants, it is preferred to use hydrophilic compounds, but those having carboxyl groups preferably do not have lipophilic groups such as hydroxypropoxyl group and methoxyl group. Specifically, usable compounds are the water-soluble cellulose ethers such as carboxymethyl cellulose, carboxyethyl cellulose, etc., but particularly preferred is carboxymethyl cellulose. The cellulose has an etherification value of from 0.6 to 1.5, and an average polymerization degree of 50 to 3,000. The carboxyl group may be a metal salt of sodium, potassium, magnesium, etc.

There are no particular limitations concerning the apparatus for use in the dispersing and suspending process so long as a commercially available emulsifier or disperser is used. For instance, there can be exemplified a batch type emulsifier such as ULTRA TURRAX (manufactured by IKA Werke.), Polytron (Kinematika Co., Ltd.), TK Auto Homomixer (Tokushu Kika Kogyo Co., Ltd.), National Cooking Mixer (Matsushita Electric Industrial Co., Ltd.), etc.; a continuous type emulsifier such as Ebara Milder (Ebara Corporation), TK Pipeline Homomixer and TK Homomik Line Flow (Tokushu Kika Kogyo Co., Ltd.), Colloid Mill (Shinko Pantek Co., Ltd.), Slusher and Trigonal Wet Grinder (Mitsui Miike Kakoki Co., Ltd.), Cavitron (Eurotek Inc.), Fine Flow Mill (Taiheiyo Kiko Co., Ltd.), etc.; a batch and continuous emulsifier such as Cleamix (M Technique Co., Ltd.), Fillmix (Tokushu Kika Kogyo Co., Ltd.), etc.; a high pressure emulsifier such as Microfluidizer (Mizuho Kogyo Co., Ltd.), Nanomaker and Nanomizer (Nanomizer Inc.), APV Goulin (Goulin Inc.), etc.; a membrane emulsifier such as Membrane emulsifier (Reika Kogyo Co., Ltd.); a vibration type emulsifier such as Vibromixer (Reika Kogyo Co., Ltd.); and an ultrasonic disintegrator such as Ultrasonic Homogenizer (Branson Inc.).

In the method according to the present invention, the third step corresponds to the solvent removal process of the suspension obtained in the second step. In the solvent removal process, the solvent is removed from the suspension obtained in the dispersing and suspending process above to obtain a toner dispersion. The toner dispersion obtained in this step must be in the form of a liquid in which the toner material and the inorganic dispersants and the like are dispersed without being dried. The solvent removal of the suspension may be carried out just after the dispersing and suspending process, however, to obtain the toner grains with a superior uniform particle size distribution, the suspension is preferably allowed to stand still for a duration of 1 to 5 minutes after the dispersing and suspending process to thereby obtain a stable particle size distribution.

By applying the apparatus for removing solvents and the system for removing solvents to the method of producing a toner for use in electrostatic charge image development, the solvent can be efficiently removed from a suspension containing the toner material in an industrial base and yet, without impairing the particle size distribution and the morphology of the toner grains.

Furthermore, in dropping the dispersed suspension from the liquid supporting member to the lower liquid supporting member, the dispersed suspension is preferably provided in such a manner that it comprises at least a columnar portion, because, by employing such a constitution, less impact force is applied to the dispersed suspension in falling down, larger contact area can be obtained between the suspension and the gas, more stable suspension can be maintained in the inert gas flow blown thereto, and little gas is incorporated into the liquid to thereby suppress foaming of the suspension.

To efficiently promote the solvent removal by removing the evaporated solvent, the suspension is preferably brought into contact with the inert gas at the gas-liquid interface under a wind velocity of 0.1 m/sec or higher but not higher than 5 m/sec. A wind velocity lower than 0.1 m/sec is not preferred, because the vaporized solvent remains and the solvent removal cannot be efficiently promoted. If the wind velocity exceeds 5 m/sec, on the other hand, it is not preferred because the dispersed suspension cannot maintain the columnar shape.

Furthermore, during the process above, the dispersed suspension is preferably dropped from a height not higher than 50 cm to suppress the stress that is applied to the dispersed suspension. To efficiently drop the dispersed suspension, the height is preferably 0.3 cm or more but not more than 50 cm. If the height should exceed 50 cm, the velocity of the dispersed suspension during its falling off becomes too high as to suffer an excessive stress on reaching the liquid plane, which cleaves the toner grains to generate fine particles. This results in toner grains which yield an unfavorable broad particle size distribution.

In the process following the solvent removal step, the peripheral velocity of the stirring paddle is preferably set at 70 m/min or lower in order to suppress the stress applied to the dispersed suspension, and from the viewpoint of achieving favorable mixing in the tank for receiving the processing solution, the peripheral velocity of the stirring paddle is set in a range of 10 m/min or higher but not higher than 70 m/min. If the peripheral speed should exceed 70 m/min, the toner grains undergo cleaving due to the excessive stress applied by the stirrer, and generate fine particles which result in a product having a broad particle size distribution. As the gas for use in the method of producing a toner for use in electrostatic charge image development according to the present invention, preferred is to use an inert gas, because a solvent is incorporated in the suspension. By further taking the cost into account, particularly preferred is the use of an inexpensive gaseous nitrogen.

The purity of the inert gas is set higher than the purity corresponding to the explosion limit of oxygen concentration. Otherwise, the inert gas may be mixed with air such that the oxygen concentration is controlled to be lower than the explosion limit of oxygen.

Furthermore, in case of applying a thermal energy to the suspension before supplying the dispersed suspension to the apparatus for removing solvents, the efficiency of solvent removal is higher for a higher temperature so long as the temperature is within the range up to the glass transition point of the binder resin incorporated in the dispersed suspension. However, from the viewpoint of safety, a temperature lower than the glass transition point of the binder resin incorporated into the dispersed suspension by 10 to 25° C. is preferred.

The method of producing a toner for use in electrostatic charge image development according to the present invention may additionally comprise the following steps if necessary. Firstly, a step of preparing a toner cake (i.e., rinsing and dehydration process) comprises rinsing and dehydration after removing the aqueous medium from the toner dispersion obtained in the third solvent removal process above. In the rinsing and the dehydration step, the toner dispersion obtained in the solvent removal process is treated with an acid to dissolve the inorganic dispersant, which is then rinsed with water and dehydrated. Still further, an alkali treatment step may be added.

The process that is performed subsequent to the process above is the process of producing the toner for use in the electrostatic charge image development (i.e., drying and sieving process) which comprises drying the toner cake obtained in the rinsing and dehydration process above, sieving, and adding additives. In these process steps, the drying, sieving, and adding may be carried out by any method so long as the toner are free from agglomeration and size reduction.

The present invention is described in further detail below by way of specific examples, but it should be understood that the present invention is by no means limited thereto. In the description below, all "parts" signify "parts by weight".

EXAMPLE 1

[Mixing Process]

The components below were dispersed in a ball mill for a duration of 24 hours to obtain 500 parts of mixed solution of toner materials into which polyester resin is dissolved.

| | |
|---|---|
| Polyester resin (Tg 66° C., Tm 106° C.); comprises Bisphenol A propylene oxide adduct, Bisphenol A oxide adduct, and terephthalic acid derivative | 90 parts |
| C.I. Pigment Blue | 5 parts |
| Paraffin Wax (melting point: 89° C.) | 5 parts |
| Ethyl acetate | 400 parts |

[Dispersing and Suspending Process]

The components below were introduced into an ultrasonic disperser, and were stirred to obtain an aqueous medium. While stirring 20 kg of the aqueous medium at a peripheral velocity of 23.6 m/sec by using ULTRA TURRAX (manufactured by IKA-Werke), 10 kg of the mixed solution of the toner material above was added thereto, and after continuing stirring for 3 minutes, the process was stopped to obtain 30 kg of suspension.

| | |
|---|---|
| Calcium carbonate (av. particle size: 80 nm) coated with acrylic-maleic copolymer (Mn: 10,000) | 10 parts |
| Deionized water | 90 parts |

[Solvent Removal Process]

A $30\times10^{-3}$ $m^3$ portion of the suspension obtained in the dispersing and suspending process above was fed into the tank for receiving the processing solution 12 of the solvent removal system according to the present invention as shown in FIG. 1, and by using the liquid transportation pump 22, the suspension was supplied to each of the solvent removal units at a flow rate of $20\times10^{-3}$ $m^3$/sec. During this process, the suspension was dropped in the form of columns. The flow rate per one hole provided to the bottom portion of the liquid supporting member was found to be 50 cc/min. At the same time, gaseous nitrogen was introduced at a rate of 20 $m^3$/H from the gas blower member 38. The wind velocity of the gaseous nitrogen at the surface of the suspension was found to be 1.0 m/sec. Furthermore, in supplying the suspension to the solvent removal unit, hot water maintained at 35° C. was passed through the double pipe heat exchanger 14 to supply thermal energy to the suspension. The distance between the liquid supporting members (i.e., the height in dropping the suspension) was 10 cm, and the stirring paddle 13 was operated at a peripheral velocity of 50 m/min.

Under the conditions above, the toner dispersion was obtained in about 1 hour.

[Rinsing and Dehydration Process]

To 200 parts by weight of the toner dispersion obtained in the solvent removal process above, 40 parts by weight of 10 N hydrochloric acid was added, and rinsing by means of suction filtration using deionized water was repeated 4 times to obtain a toner cake.

[Drying and Sieving Process]

The toner cake obtained in the dehydration process was dried in vacuum drier, and was classified using a 45-$\mu$m mesh sieve to obtain the toner for use in the electrostatic charge image development.

The toner thus obtained yielded a very sharp particle size distribution, and the toner grains were uniform in shape.

EXAMPLES 2 TO 10

Toners for use in the electrostatic charge image development were prepared in the same manner as in Example 1, except for changing, as is shown in Table 1 below, the manner of contacting the suspension with the gas at the removal of solvent in the solvent removal step, the flow rate per hole provided on the bottom portion of the liquid supporting member, the wind velocity at the surface of the suspension, the drop height, or the peripheral velocity of stirring. In Table 1 are summarized the conditions and the results.

COMPARATIVE EXAMPLE 1

A toner for use in the electrostatic charge image development was prepared in the same manner as in Example 1, except for changing the solvent removal process as described below.

[Solvent Removal Process]

A $30\times10^{-3}$ $m^3$ portion of the suspension obtained in the dispersing and suspending process was fed into a vessel similar to the tank for receiving the processing solution 12 shown in FIG. 1, and while heating the periphery of the vessel by using hot water maintained at 35° C. and stirring at a peripheral velocity of 50 m/min, the surface of the suspension was forcibly renewed by means of a blower. The wind velocity at the interface between the gas and the liquid was 3.5 m/sec.

Under the conditions above, 38 hours was necessary to obtain the toner dispersion. The toner thus obtained yielded a sharp particle size distribution and the grains were uniform in shape.

COMPARATIVE EXAMPLE 2

A toner for use in the electrostatic charge image development was prepared in the same manner as in Example 1, except for changing the solvent removal process as described below.

[Solvent Removal Process]

A $30\times10^{-3}$ $m^3$ portion of the suspension obtained in the dispersing and suspending process was supplied to a double-fluid spray nozzle at a rate of $2.4\times10^{-3}$ $m^3$/min and supplying gaseous nitrogen under a condition of 2 kgf/$cm^2$, and was sprayed onto the upper surface of the suspension while heating the periphery of the vessel by using hot water maintained at 35° C. and stirring at a peripheral velocity of 30 m/min. The dropping height was 30 cm, and the average wind about velocity at the interface between the gas and the liquid was 2.0 m/sec.

Under the conditions above, 2 hours was necessary to obtain the toner dispersion. The toner thus obtained yielded a broad particle size distribution and the grains were rather non-uniform in shape.

COMPARATIVE EXAMPLE 3

A toner for use in the electrostatic charge image development was prepared in the same manner as in Example 1, except for changing the solvent removal process as described below.

[Solvent Removal Process]

From $30\times10^{-3}$ $m^3$ portion of the suspension obtained in the dispersing and suspending process, a $3\times10^{-4}$ $m^3$ portion was placed into a beaker. This portion was stirred with a relatively large stirring blade at a peripheral velocity of 200 m/min while heating it by using hot water maintained at 35° C. During this process, the suspension was found to rotate together with the stirring blade, and due to the centrifugal force applied thereto, it was pressed against to the beaker wall in the form of a thin film.

While stirring under the conditions above, the surface of the suspension was forcibly renewed by means of a blower. The wind velocity at the interface between the gas and the liquid was 3.5 m/sec.

Under the conditions above, 2 hours was necessary to obtain the toner dispersion. The toner thus obtained yielded a broad particle size distribution and the grains were non-uniform in shape.

The results are summarized in Table 1 below. In the table, the particle size distribution and the uniformity in shape of the toner grains were evaluated as follows.

[Particle Size Distribution of the Toner Grains]

The grain diameter and the particle size distribution of the toner were measured by using Coulter Multisizer II (manufactured by Coulter Inc.) under an aperture diameter of 50 $\mu$m. As a scale to express the width in particle size distribution, GSD (Geometrical Standard Deviation) was used. GSD is obtained as a ratio of (average grain diameter of grains accounting for 50% in number of the entire toner grains (50% number average particle size diameter)) to (84% number average particle size diameter), and those having a GSD value of less than 1.6 were evaluated "Excellent", those having a GSD value of 1.6 or higher but less than 1.8 were evaluated "Good", those having a GSD value of 1.8 or higher but less than 2.5 were evaluated "Fair", and those having a GSD value of 2.5 or higher were evaluated "Poor".

[Uniformity in Toner Grain Shape]

In the electron micrograph obtained for the toner under a scanning electron microscope at a magnification of 1000, 100 toner grain images were randomly selected. Thus, the uniformity in shape was evaluated according to the ratio of the heterogeneous grains present in the total number of grains. If heterogeneous grains account for less than 5%, the evaluation is "Excellent"; if those account for 5% or higher but less than 15%, the evaluation is "Good", similarly, for 15% or higher but less than 30%, and for 30% or higher, the evaluation are "Fair" and "Poor".

TABLE 1

| | Principal manner of g/l contact | Flow rate (per hole) (cc/min) | Wind velocity at g/l interface (m/sec) | Drop height (cm) | Peripheral velocity of stirring (m/min) | Solvent removal time (H) | Particle size distribution of toner | Uniformity in toner grain shape |
|---|---|---|---|---|---|---|---|---|
| Example 1 | columnar | 50 | 1.0 | 10 | 50 | 1 | Excellent | Excellent |
| Example 2 | columnar | 100 | 0.1 | 45 | 65 | 1.2 | Good | Excellent |
| Example 3 | columnar | 150 | 3.0 | 30 | 35 | 0.8 | Good | Excellent |
| Example 4 | columnar | 200 | 4.5 | 20 | 30 | 0.7 | Excellent | Excellent |
| Example 5 | columnar | 250 | 2.0 | 15 | 40 | 0.9 | Excellent | Excellent |
| Example 6 | columnar | 300 | 0.5 | 10 | 25 | 1.1 | Excellent | Excellent |
| Example 7 | columnar | 200 | 0.05 | 15 | 40 | 4.5 | Excellent | Excellent |
| Example 8 | columnar | 70 | 0.5 | 15 | 75 | 1.1 | Fair | Good |
| Example 9 | columnar | 50 | 0.2 | 60 | 35 | 1.2 | Fair | Good |
| Example 10 | columnar | 450 | 1.0 | 10 | 50 | 1 | Fair | Good |
| Comparative Example 1 | flat plane | — | 3.5 | 0 | 35 | 38 | Excellent | Good |
| Comparative Example 2 | spray | — | 2.0 | 30 | 30 | 2 | Poor | Fair |
| Comparative Example 3 | thin film | — | 0.5 | 0 | 200 | 2 | Poor | Poor |

EXAMPLE 11

[Mixing Process]

The components below were dispersed in a disperser for a duration of 6 hours to obtain 500 parts of a solution in which styrene-n-butyl acrylate resin is dissolved.

| | |
|---|---|
| Styrene-n-butyl | 100 parts |
| Ethyl acetate | 400 parts |

[Dispersing and Suspending Process]

The components below were introduced into an ultrasonic disperser, and were stirred to obtain an aqueous medium. While stirring 20 kg of the aqueous medium at a peripheral velocity of 23.6 m/sec by using ULTRA TURRAX (manufactured by IKA-Werke), 10 kg of the resin solution above was added thereto, and after continuing stirring for 3 minutes, the process was stopped to obtain 30 kg of suspension.

| | |
|---|---|
| Calcium carbonate (av. particle size: 80 nm) coated with acrylic-maleic copolymer (Mn: 10,000) | 10 parts |
| Deionized water | 90 parts |

[Solvent Removal Process]

A $30\times10^{-3}$ $m^3$ portion of the suspension obtained in the dispersing and suspending process above was fed into the tank for receiving the processing solution 12, as shown in FIG. 1, of the solvent removal system according to the present invention, and by using the liquid transportation pump 22, the suspension was supplied to each of the solvent removal units at a flow rate of $20\times10^{-3}$ $m^3$/sec. During this process, the suspension was dropped in the form of columns. At the same time, gaseous nitrogen was introduced at a rate of 20 $m^3$/H from the gas blower member 38. The wind velocity of the gaseous nitrogen at the surface of the suspension was found to be 1.0 m/sec. Furthermore, in supplying the suspension to the solvent removal unit, hot water maintained at 35° C. was passed through the double pipe heat exchanger 14 to supply thermal energy to the suspension. The distance between the liquid supporting members (i.e., the height in dropping the suspension) was 10 cm, and the stirring paddle 13 was operated at a peripheral velocity of 50 m/min.

Under the conditions above, the toner dispersion was obtained in about 1 hour.

[Rinsing and Dehydration Process]

To 200 parts by weight of the resin dispersion obtained in the solvent removal process above, 40 parts by weight of 10 N hydrochloric acid was added, and rinsing by means of suction filtration using deionized water was repeated 4 times to obtain a resin cake.

[Drying and Sieving Process]

The resin cake obtained in the dehydration process was dried in vacuum drier, and was classified using a 45-$\mu$m mesh sieve to obtain the resin particles.

The resin particles thus obtained yielded a very sharp particle size distribution, and the particles were uniform in shape.

EXAMPLE 12

[Mixing Process]

To a mixed solution containing 35 parts of Isopal M (manufactured by Exxon Chemicals Inc.) and 100 parts of methyl ethyl ketone, 95 parts of a lauryl methacrylate/styrene copolymer ($Mw=6\times10^4$) and 0.1 part of an oil-soluble surfactant (Homogenol L-18, dry product, manufactured by Kao Corporation) were added and dissolved. A magnetic powder (EPT-1000, manufactured by Toda Kogyo Corporation) was added to the resulting solution at an amount of 100 parts, and was dispersed in a sand mill for a duration of 3 hours. Then, to 100 parts of the resulting dispersion, 20 parts of polyisocyanate (Takenate D110N, manufactured by Takeda Chemical Industries, Ltd.) and 10 parts of methyl ethyl ketone were added and mixed thoroughly. The resulting dispersion is denoted "Liquid A", hereinafter.

Separately, 10 parts of hydroxyethylpropylmethylcellulose (Metlose 65SH50, manufactured by Shin-Etsu Chemical Co., Ltd.) was dissolved into 200 parts of deionized water, and the resulting solution was cooled to 5° C. The resulting solution is denoted as "Liquid B", hereinafter.

[Dispersing and Suspending Process, Pretreatment for Encapsulation]

The liquid B was stirred with an emulsifier ULTRA TURRAX (manufactured by IKA-Werke), and liquid A was gradually added therein for emulsification. Thus was obtained an O/W emulsion comprising an emulsion having dispersed therein oil droplet particles 12 $\mu$m in diameter. Then, the resulting emulsion was stirred with a disperser equipped with propeller type stirring blades at a speed of 400 revolutions/minute. After 10 minutes, 100 parts of an aqueous 2.5% solution of diethylenetriamine was added to provide a second monomer for forming the capsules.

[Reaction/Solvent Removal Process]

A $30\times10^{-3}$ $m^3$ portion of the suspension obtained in the previous process was fed into the tank for receiving the processing solution 12of the solvent removal system according to the present invention as shown in FIG. 1, and by using the liquid transportation pump 22, the suspension was supplied to each of the solvent removal units at a flow rate of $20\times10^{-3}$ $m^3$/sec. During this process, the suspension was dropped in the form of columns. At the same time, gaseous nitrogen was introduced at a rate of 20 $m^3$/H from the gas blower member 38. The wind velocity of the gaseous nitrogen at the surface of the suspension was found to be 1.0 m/sec. Furthermore, in supplying the suspension to the solvent removal unit, hot water maintained at 35° C. was passed through the double pipe heat exchanger 14 to supply thermal energy to the suspension. The distance between the liquid supporting members (i.e., the height in dropping the suspension) was 10 cm, and the stirring paddle 13 was operated at a peripheral velocity of 50 m/min.

Under the conditions above, the capsulated resin dispersion was obtained in about 1 hour.

[Rinsing and Dehydration Process]

Rinsing by means of suction filtration using deionized water was repeated 7 times on the resin dispersion prepared in the process above to obtain a resin cake.

[Drying and Sieving Process]

The resin cake obtained in the dehydration process was dried in vacuum drier, and was classified using a 45-$\mu$m mesh sieve to obtain the resin particles.

The resin particles thus obtained yielded a very sharp particle size distribution, and the particles were uniform in shape.

As described above, by using the apparatus for removing solvents, the system for removing solvents, and the method for removing solvents according to the present invention, solvents can be removed from solvent suspensions at high efficiency and without excessively applying stress and strain to the solvent suspension, and yet, without being influenced by the production scale. Moreover, the resulting particles yields a sharp particle size distribution and are uniform in shape.

Furthermore, the method for producing toners for use in electrostatic charge image development according to the present invention enables, at high efficiency and without being influenced by the production scale, toners for use in electrostatic charge image development having excellent properties, such that they yield sharp particle size distribution and that are uniform in shape.

While the invention has been described in detail by making reference to specific examples, it should be understood that various changes and modifications can be made without departing from the scope and the spirit of the present invention.

What is claimed is:

1. A solvent removal apparatus for removing solvents comprising:

an upper liquid supporting member supporting a solvent suspension, said upper liquid supporting member defining an open hole at a bottom portion of said upper liquid supporting member;

a lower liquid supporting member, disposed separately on a position lower than said upper liquid supporting member, supporting the solvent suspension, wherein said solvent suspension is dropped from said open hole of said upper liquid supporting member to said lower liquid supporting member and the solvent suspension is brought in contact with a gaseous phase during dropping; and wherein said open hole is configured so that a flow rate of the solvent suspension through said open hole is 400 cc/min or less.

2. The solvent removal apparatus for removing solvents as claimed in claim 1, wherein, the solvent suspension is dropped in such a manner that the solvent suspension has at least a columnar portion while it is being dropped.

3. The solvent removal apparatus for removing solvents as claimed in claim 1, wherein said open hole is configured so that the flow rate of the solvent suspension through said open hole is between 10 cc/min and 400 cc/min.

4. The solvent removal apparatus for removing solvents as claimed in claim 1, wherein said upper and lower liquid supporting members are provided horizontally, and wherein said upper and lower liquid supporting members are arranged vertically in a plurality of stages.

5. The solvent removal apparatus for removing solvents as claimed in claim 1, further comprising:

a porous member capable of discharging a gas is provided between the upper liquid supporting member and the lower liquid supporting member.

6. The solvent removal apparatus for removing solvents as claimed in claim 1, further comprising:

a processing solution supply mechanism, that uniformly supplies the solvent suspension, disposed on an upper liquid supporting member of an uppermost stage of a series of vertically arranged stages each comprising an upper and a lower liquid supporting member.

7. The solvent removal apparatus for removing solvents as claimed in claim 5, further comprising:

a gas discharge tube for discharging a gas.

8. The solvent removal apparatus for removing solvents as claimed in claim 5, wherein further comprising a liquid receiving vessel equipped with a stirring means, and a heat exchanger, provided with a line for circulating the solvent suspension among them.

9. A method for removing solvents comprising the steps of:

dropping a solvent suspension from an upper liquid supporting member which supports the solvent suspension and which has an open hole at a bottom portion, to a lower liquid supporting member provided at a lower side and separately from said upper liquid supporting member; and contacting the solvent suspension with a gaseous phase while dropping the solvent suspension through the open hole at a flow rae ob 400 cc/min or less.

10. The method for removing solvents as claimed in claim 9, wherein in the gas-liquid interface during dropping the solvent suspension, the solvent is removed by bringing the solvent suspension into contact with the gas phase under a wind velocity in a range of from 0.1 m/sec to 5 m/sec.

11. The method for removing solvents as claimed in claim 9, wherein in removing the solvent from the solvent suspension, the solvent suspension is dropped from a height of 50 cm or lower.

12. The method for removing solvents as claimed in claim 9, further comprising the following step:

stirring the solvent suspension after removing the solvent, wherein the peripheral velocity of stirring during the step of stirring is set at 70 m/min or lower.

* * * * *